US009871313B2

(12) United States Patent
Saito et al.

(10) Patent No.: US 9,871,313 B2
(45) Date of Patent: Jan. 16, 2018

(54) RECEPTACLE CONNECTOR

(71) Applicant: YAZAKI CORPORATION, Tokyo (JP)

(72) Inventors: Atsuhito Saito, Susono (JP); Koji Hayashi, Yokohama (JP)

(73) Assignee: YAZAKI CORPORATION, Tokyo (JP)

( * ) Notice: Subject to any disclaimer, the term of this patent is extended or adjusted under 35 U.S.C. 154(b) by 90 days.

(21) Appl. No.: 14/163,029

(22) Filed: Jan. 24, 2014

(65) Prior Publication Data

US 2014/0141648 A1 May 22, 2014

Related U.S. Application Data

(63) Continuation of application No. PCT/JP2012/069786, filed on Jul. 27, 2012.

(30) Foreign Application Priority Data

Jul. 27, 2011 (JP) ..... 2011-164625

(51) Int. Cl.
*H01R 13/648* (2006.01)
*H01R 13/24* (2006.01)
*H01R 13/11* (2006.01)

(52) U.S. Cl.
CPC ..... *H01R 13/24* (2013.01); *H01R 13/112* (2013.01)

(58) Field of Classification Search
CPC ..... H01R 23/7073; H01R 23/6873; H01R 13/658; H01R 13/65802
USPC ..... 439/607.35, 0.4, 607.54, 0.56, 660
See application file for complete search history.

(56) References Cited

U.S. PATENT DOCUMENTS

| | | | | |
|---|---|---|---|---|
| 7,485,008 | B1 | 2/2009 | Yi et al. | |
| 7,806,732 | B1 * | 10/2010 | Yen | 439/660 |
| 7,955,137 | B2 * | 6/2011 | Ko et al. | 439/660 |
| 8,535,103 | B2 * | 9/2013 | Lim et al. | 439/741 |
| 2003/0199211 | A1 | 10/2003 | Fukatsu et al. | |
| 2006/0134983 | A1 | 6/2006 | Wang et al. | |
| 2007/0077818 | A1 | 4/2007 | Iwakawa | |
| 2009/0298334 | A1 | 12/2009 | Takahashi | |
| 2013/0237093 | A1 | 9/2013 | Kamarauskas et al. | |

FOREIGN PATENT DOCUMENTS

| | | |
|---|---|---|
| CN | 201656090 U | 11/2010 |
| JP | S52-12141 | 3/1977 |
| JP | H03-134972 A | 6/1991 |

(Continued)

OTHER PUBLICATIONS

Japanese Office Action dated Mar. 17, 2015 in corresponding Japanese Patent Application No. 2011-164625.

(Continued)

*Primary Examiner* — Hien Vu
(74) *Attorney, Agent, or Firm* — Morgan, Lewis & Bockius LLP

(57) ABSTRACT

A receptacle connector includes: a shielding case; an insulator accommodated in the shielding case; and a first contact arranged on a terminal supporting part of the insulator. A clearance is provided between a tip of the terminal supporting part of the insulator and a tip of the first contact. The tip of the terminal supporting part has an inclined surface to provide the clearance.

6 Claims, 6 Drawing Sheets

(56) References Cited

FOREIGN PATENT DOCUMENTS

| | | | |
|---|---|---|---|
| JP | H11-111368 | A | 4/1999 |
| JP | 2007-157378 | A | 6/2007 |
| JP | 2009192702 | A | 8/2009 |
| JP | 3176191 | | 6/2012 |
| KR | UM20-0370937 | Y1 | 12/2004 |
| TW | I322533 | B | 3/2010 |

OTHER PUBLICATIONS

International Search Report dated Nov. 27, 2012 for International application No. PCT/JP2012/069786.
Korean Office Action dated Dec. 18, 2014 for corresponding Patent Application No. 10-2014-7001288.
Notice of Decision of Rejected dated Oct. 2, 2015, from the Korean Intellectual Property Office (KIPO) in counterpart Korean Application No. 10-2014-7001288.
Taiwanese Office Action dated Apr. 22, 2015, for corresponding patent application No. 101127172.
Notice of Decision of Rejection dated Jul. 27, 2015 from the Korean Intellectual Property Office (KIPO) in counterpart Korean Application No. 10-2014-7001288.
Notification of the First Office Action from the State Intellectual Property Office of the People's Republic of China dated Jun. 4, 2015, in counterpart Chinese Application No. 201280036937.3.
Notification of the Second Office Action dated Jan. 4, 2016 from the State Intellectual Property Office of the People's Republic of China in counterpart Chinese Application No. 201280036937.3.
Communication dated Jan. 26, 2016, from the European Patent Office in counterpart European Application No. 12750836.4-1801.
Trial Decision dated Dec. 21, 2016, from the 9th Division of the Intellectual Property Tribunal, Korean Intellectual Property Office in counterpart Korean Patent Application No. 2014-7001288.
European Office Action dated Jul. 31, 2017 in corresponding European Patent Application No. 12 750 836.4.

* cited by examiner

RECEPTACLE CONNECTOR

CROSS REFERENCE TO RELATED APPLICATIONS

This application is a continuation of PCT application No. PCT/JP2012/069786, which was filed on Jul. 27, 2012 based on Japanese Patent Application (No. 2011-164625) filed on Jul. 27, 2011, the contents of which are incorporated herein by reference.

BACKGROUND OF THE INVENTION

1. Field of the Invention

The present invention relates to a receptacle connector attached to a circuit board or the like.

2. Description of the Related Art

For example, PTL 1 and PTL 2 discloses a receptacle connector that is attached to a circuit board for the purpose of connecting electric wires to the circuit board and that is fit with a plug connector connected to the end part of the electric wires.

As shown in FIG. 8, for example, the connector (a receptacle connector) 501 disclosed in PTL 1 includes a housing (an insulator) 505 composed of insulating resin material provided inside a shielding case 503 for connector. A tongue (a terminal supporting part) 507 is formed in the housing 505. Then, the tongue 507 protrudes toward a connector insertion slot 509. The tongue 507 is provided with a plurality of grooves extending in the protruding direction. Each groove accommodates a terminal (a receptacle-side contact) 511 composed of conductive metal. The terminal 511 is electrically connected by soldering or the like to an electric conduction trace of the circuit board connected to a metal connection pad.

Further, although illustration is omitted, in the electronic component for surface mount disclosed in PTL 2, above an upper part of a compensation member, a cover having an L-shaped cross section is arranged that protects terminal leads (receptacle-side contacts) and that provides a pressing force to the compensation member when the compensation member is pressed fit into the mounting board. Then, the electronic component for surface mount is fixed, for example, to the side-face plate of the housing before the elastic bonding part is surface-mounted on the mounting board. Fixing of the compensation member and the receptacle-side contacts may be achieved by insert molding in place of insertion fixing performed after fabrication of the compensation member.

CITATION LIST

Patent Literature

[PTL 1] JP-A-2007-157378

[PTL 2] JP-A-3-134972

Nevertheless, in a case that the tip rear face of the terminal 511 supported by the tongue 507 is in contact with the groove bottom surface of the tongue 507, the tip of the terminal 511 acts as a rigid body formed integrally with the tongue 507. Thus, the tip of the terminal 511 is inhibited from retreating in the anti-contact direction. Accordingly, when a partner terminal (a plug-side contact) (not shown) first becomes in contact with the terminal 511, the reaction force generated by the contact becomes large. The increase in the reaction force causes an increase in the insertion resistance of the terminal. Further, the increase in the reaction force causes an increase in the compression force acting on both terminals in the directions parallel to the insertion direction. When the compression force exceeds a predetermined value, a possibility arises that both terminals suffer deformation (permanent deformation) such as buckling and droop.

SUMMARY OF THE INVENTION

It is therefore an aspect of the invention to provide a receptacle connector in which the insertion force is reduced so that deformation in the contacts is hardly generated even in long-term repeated use.

In order to achieve this aspect, according to the invention, there is provided a receptacle connector comprising: a shielding case; an insulator accommodated in the shielding case; and a first contact arranged on a terminal supporting part of the insulator, a clearance provided between a tip of the terminal supporting part of the insulator and a tip of the first contact, wherein the tip of the terminal supporting part has an inclined surface to provide the clearance.

The clearance may increase toward the tip of the terminal supporting part so as to have a wedge shape.

When the receptacle connector is fitted to a plug connector, the first contact is in contact with a second contact of the plug connector, and the first contact is allowed to retreat in an anti-contact direction relative to the second contact in the clearance.

The first contact may include a plurality of contacts arranged in a width direction of the terminal supporting part of the insulator.

According to an aspect of the invention, when the receptacle-side contact is supported by the terminal supporting part, a clearance is formed between the tip of the terminal supporting part and the tip of the receptacle-side contact. Thus, in the receptacle-side contact, the tip part alone becomes a free end that is displaceable in the anti-contact direction. When fitting of the plug connector into the receptacle connector is started and the plug-side contact becomes in contact with the tip of the receptacle-side contact, in the receptacle-side contact, the tip part alone is elastically deformed so as to retreat into a back clearance formed by the clearance. This elastic deformation in the receptacle-side contact reduces the reaction force generated at the time of contact of the plug-side contact with the receptacle-side contact, and thereby suppresses an increase in the insertion resistance. Further, since the reaction force is reduced, the compression force in a direction parallel to the insertion direction that acts between the partner contacts is also reduced. This suppresses the occurrence of deformation (permanent deformation) such as buckling and droop. Further, a back clearance is formed only at the tip of the terminal supporting part. This avoids a situation that the receptacle-side contact retreats in the anti-contact direction in a long distance along the direction of extension. This avoids the occurrence of residual deformation that could be generated in the anti-contact direction in a long distance along the direction of extension of the receptacle-side contact, and hence avoids, for a long time, degradation of reliability of contact with the plug-side contact.

According to an aspect of the invention, at the time that the tip of the receptacle-side contact is elastically deformed in association with the contact with the plug-side contact, a back clearance is formed by a space having a wedge shape similar to the locus generated when the free end retreats. Thus, at the time of retreat of the receptacle-side contact, excessive deformation is avoided in the receptacle-side contact and stress concentration is avoided that could be caused by abutting of the receptacle-side contact against the tip corner part or the like on the insulator side. This avoids the occurrence of permanent deformation.

According to an aspect of the invention, the insertion force is reduced so that deformation in the contacts is hardly generated even in long-term repeated use.

BRIEF DESCRIPTION OF THE DRAWINGS

FIG. 7(*b*) is an explanation diagram showing the situation of partner contacts realized immediately after the contact.

DETAILED DESCRIPTION OF THE EXEMPLARY EMBODIMENTS

A receptacle connector according to an embodiment of the present invention is described below in detail with reference to the accompanying drawings.

The receptacle connector 11 according to the present embodiment is preferably used, for example, as a receptacle connector of a digital camera or a portable phone.

Figure 1:
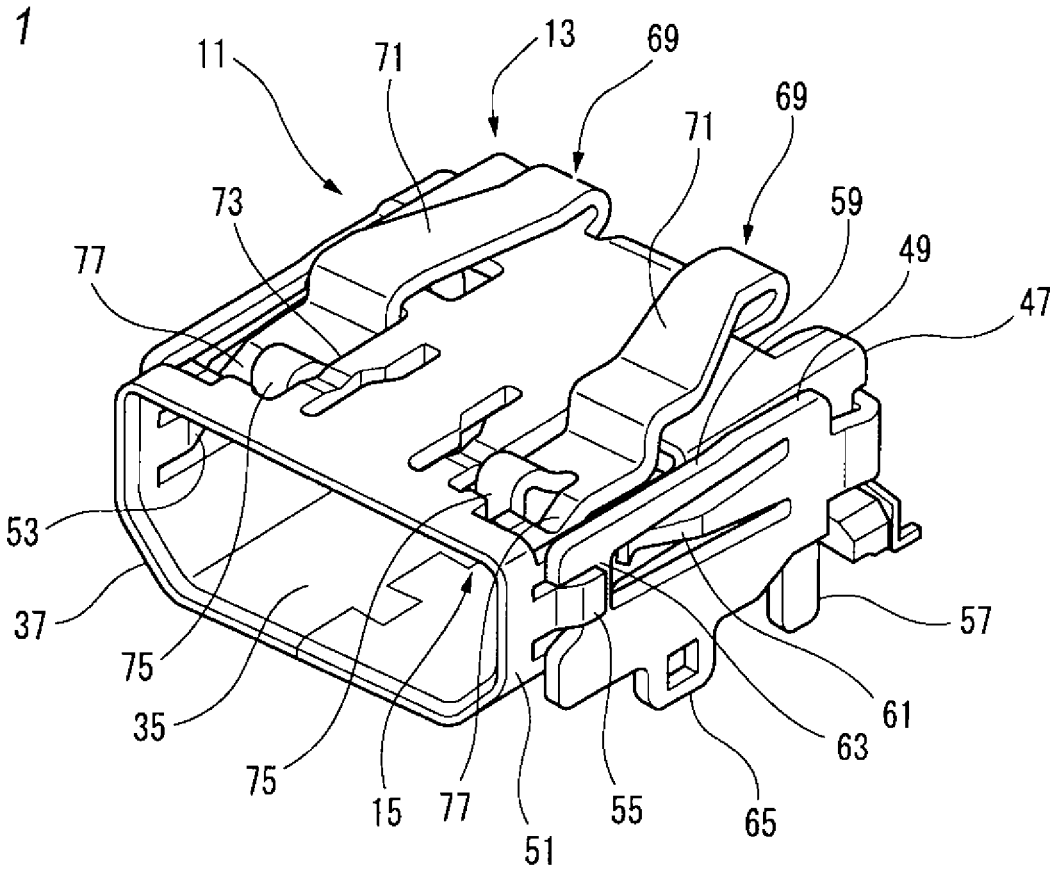
FIG. 1 is an overall perspective view of a receptacle connector according to an embodiment of the present invention.
Figure 5:
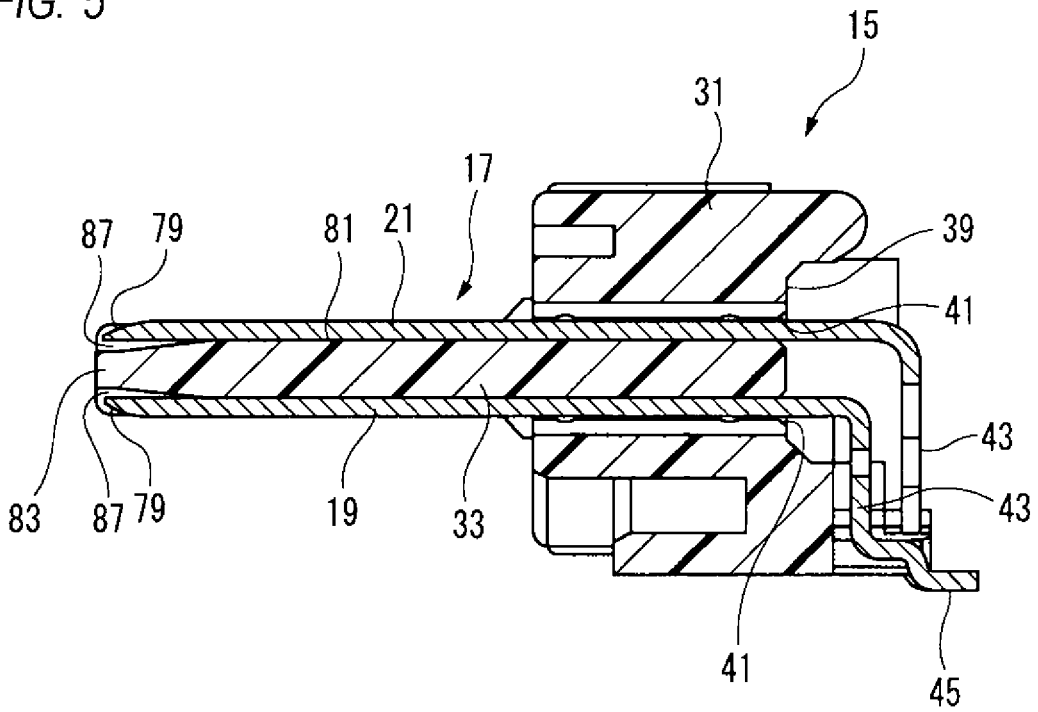
FIG. 5 is a vertical sectional view of an insulator shown in FIG. 2.

As shown in FIG. 1, the receptacle connector 11 according to the present embodiment has a first shielding case (a shielding case) 13, an insulator 15 (also referred to as a housing), and receptacle-side contacts 17. As shown in FIG. 5, each receptacle-side contact 17 includes a lower terminal 19 and an upper terminal 21.

Figure 3:
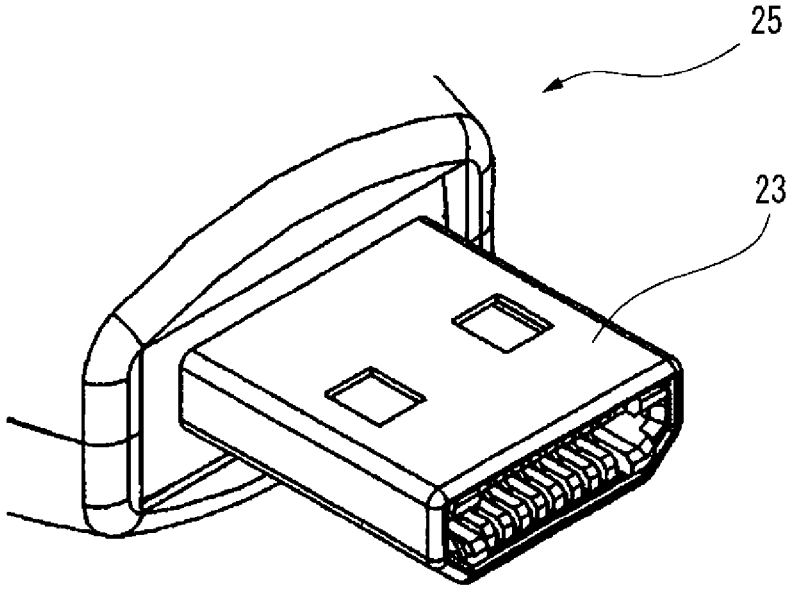
FIG. 3 is a perspective view of apart of a plug connector.
Figure 4:
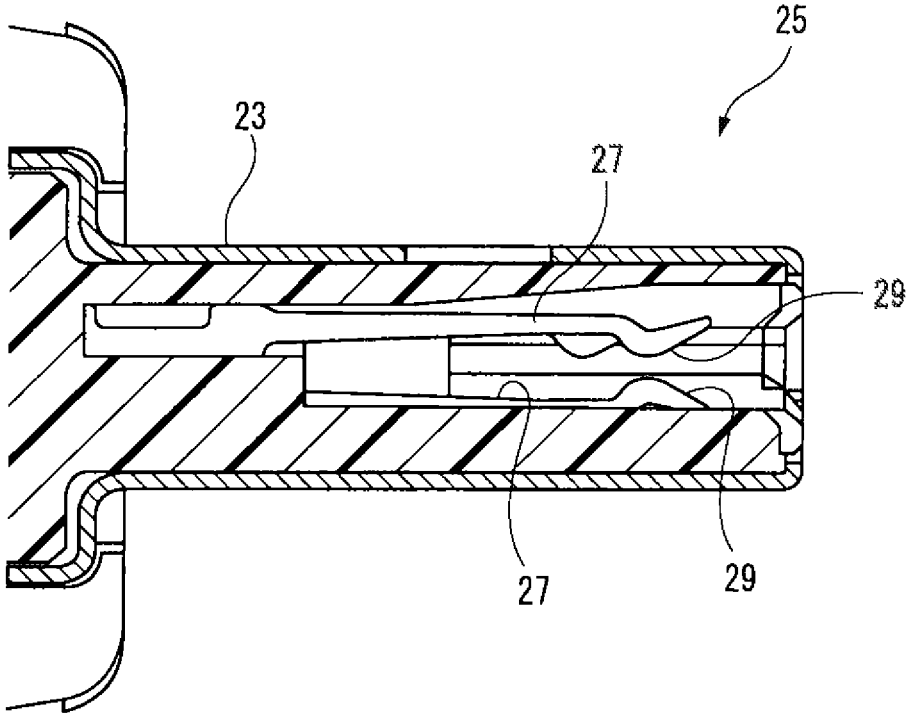
FIG. 4 is a vertical sectional view of a plug connector shown in FIG. 3.

The receptacle connector 11 is connected to a plug connector 25 including a second shielding case 23 shown in FIG. 3. When the receptacle connector 11 is connected to the plug connector 25, each receptacle-side contact 17 is electrically connected to each plug-side contact 27 of the plug connector 25. Then, these are covered by the first conductive shielding case 13 and the second shielding case 23 serving as a countermeasure against EMI (electromagnetic interference). As shown in FIG. 4, at the tip of the plug-side contact 27, an inclined surface 29 having a V-shape is formed for controlling the direction of flexibility of the plug-side contact 27 at the time of contact with the receptacle-side contact 17.

Figure 2:
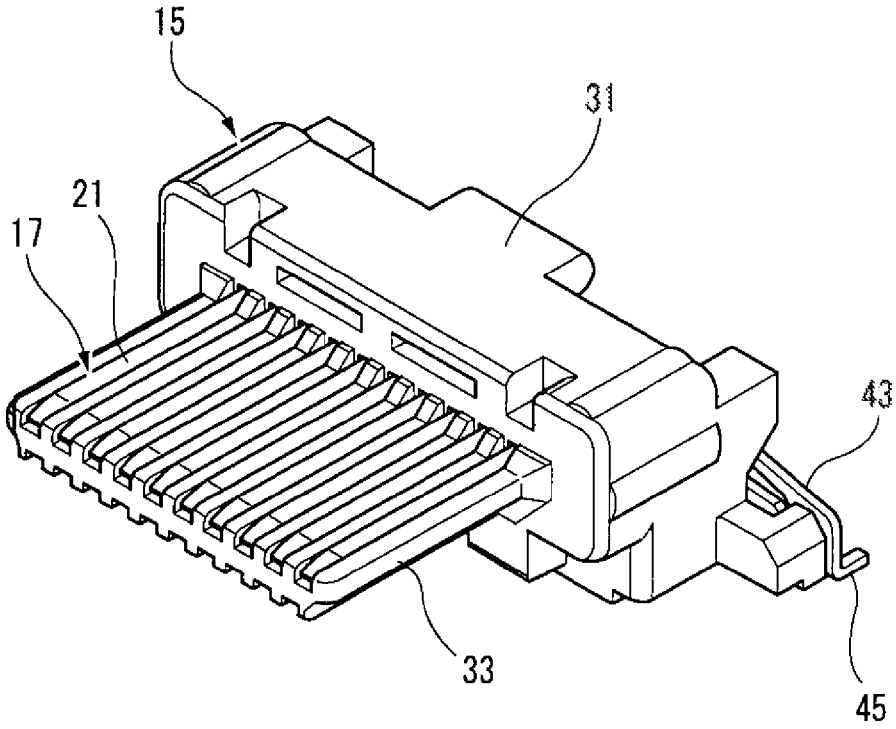
FIG. 2 is an overall perspective view of an insulator accommodated in a shielding case shown in FIG. 1.

As shown in FIG. 2, the insulator 15 is integrally formed from insulating resin material. Then, a terminal supporting part 33 protrudes from a base 31. In the terminal supporting part 33, each upper terminal 21 and each lower terminal 19 are arranged on the upper and the lower surfaces, respectively. In the receptacle connector 11, the first shielding case 13 and the insulator 15 forms a plug fitting space 35, and the end part of the first shielding case 13 serves as a plug insertion opening 37.

As shown in FIG. 5, in the base 31 of the insulator 15, the surface opposite the plug fitting space 35 (see FIG. 1) is referred to as a rear face part 39. The rear face part 39 has a plurality of terminal insertion holes 41 formed in parallel to the plug insertion direction and used for attaching the upper terminals 21 and the lower terminals 19 to the base 31. The terminal insertion holes 41 are formed in the form of through holes from the rear face part 39 in the protruding direction of the terminal supporting part 33, and arranged in two rows in the up and down directions (the thickness direction of the terminal supporting part 33) at equal intervals in the width direction of the terminal supporting part 33. The terminal insertion holes 41 in the upper row and the terminal insertion holes 41 in the lower row have different phases with each other in the width direction of the terminal supporting part 33. Each upper terminal 21 and each lower terminal 19 are is inserted into each terminal insertion hole having a different phase, from the rear face part 39 of the base 31 toward the terminal supporting part 33.

The upper terminals 21 and the lower terminals 19 are formed in the shape of an elongated plate, and each has a contact part and a press fit part that is formed continuously to the contact part and pressed fit into the terminal insertion hole 41. A leg part 43 bent by approximately 90 degrees toward the circuit board (not shown) and a lead part 45 formed in the end part of the leg part 43 and soldered to the circuit board are formed continuously to the end part of the press fit part.

In the upper terminal 21 and the lower terminal 19 inserted from the rear face part 39, the press fit part is arranged in the terminal insertion hole 41. In the press fit part pressed fit in the terminal insertion hole 41, a lock protrusion (not shown) is locked in the terminal insertion hole 41 so that the upper terminal 21 and the lower terminal 19 are held on the insulator 15.

As shown in FIG. 1, the first shielding case 13 according to the present embodiment has a shielding case body 47, an engaging support part 49, and an erroneous fitting prevention part 69.

The shielding case body 47 is fabricated by sheet metal work of a conductive material and obtained in the shape of a flattened rectangular pipe whose front part shown in FIG. 1 is opened as the plug insertion opening 37. A locking hole 53 elongated in the forward and backward directions is formed in a body side-plate part 51 of the shielding case body 47. A locking claw 55 is formed on the front side of the locking hole 53. Fixing legs 57 protrude from the rear part of the body side-plate part 51. The fixing legs 57 are fixed by soldering to through holes of a circuit board (not shown). Here, the Fixing legs 57 may be provided in the engaging support part 49.

Each engaging support part 49 is protrudes rearward from the rear end part of each body side-plate part 51 on each side of the shielding case body 47. Then, its tip is bent forward by 180°. In each engaging support part 49, on the inner side of a frame 59 punched in a U-shape, an elastic engaging plate 61 is formed that passes through the locking hole 53 of the shielding case body 47 and then engages with the second shielding case 23 of the plug connector 25 inserted into the plug fitting space 35. In front of the elastic engaging plate 61 of the frame 59, a locking edge 63 is formed that is locked by the locking claw 55 of the shielding case body 47. In the engaging support part 49, a board connection part 65 protruding toward the board is installed vertically. The board connection part 65 has the shape of a frame piece and is installed vertically at the lower edge of the engaging support part 49. The board connection part 65 is fixed by soldering to a through hole of the circuit board (not shown).

Further, the erroneous fitting prevention part 69 is provided in the shielding case body 47. In the erroneous fitting prevention part 69, each side in the width direction is provided with an arm 71 that is bent forward from the rear part of the shielding case body 47 and then extends forward. The free end part of the arm 71 starts from the outside of the shielding case body 47, then passes through a hole 73 punctured in the upper wall of the shielding case body 47, and then protrudes into the plug fitting space 35 of the shielding case body 47. In the free end part a stopper wall 75 is formed that, when an unauthorized plug (not shown) is inserted, becomes in contact with the unauthorized plug. Further, in the arm 71, a plug collecting part 77 is provided that is formed integrally with the stopper wall 75 in parallel to this and protrudes into the plug fitting space 35. Then, when an authorized plug connector 25 is inserted, the plug collecting part 77 becomes in contact with the plug connector 25.

As described above, the receptacle-side contact 17 of the receptacle connector 11 according to the present embodiment is constructed from the lower terminal 19 and the upper terminal 21. Here, the shape according to the present invention is the same in the lower terminal 19 and in the upper terminal 21. Thus, the upper terminal 21 alone is described below as an embodiment of the receptacle-side contact 17.

As shown in FIG. 5, in the contact surface at the tip of the receptacle-side contact 17, a guide surface 79 is formed in which the tip thickness is gradually reduced toward the protrusion tip. In the plug-side contact 27 and the receptacle-side contact 17, the inclined surface 29 (see FIG. 2) and the guide surface 79 abut against each other so that contact begins smoothly.

In the terminal supporting part 33, grooves 81 in each of which the receptacle-side contact 17 is arranged are formed. Each receptacle-side contact 17 is arranged in the groove 81 in a state that the upper side in the thickness direction is exposed. A clearance is provided between the tip of the terminal supporting part 83 of the insulator 15 and the tip of the receptacle-side contact 17. This clearance is formed in the bottom of the groove 81 and serves as a back clearance 87 in which at the time of fitting with the plug connector 25, the tip of the receptacle-side contact 17 is allowed to retreat in the anti-contact direction relative to the plug-side contact 27.

The clearance according to the present embodiment increases toward the tip of the terminal supporting part 83 so as to have a wedge shape. That is, the bottom surface of the groove 81 is inclined toward the tip in a direction departing from the receptacle-side contact 17. This gap whose width is gradually increasing is the above-mentioned clearance and constitutes the back clearance 87. The bottom surface of this the groove 81 is approximately equal to the position where the tip of the receptacle-side contact 17 is elastically deformed at maximum in the anti-contact direction.

Next, the operation of the receptacle connector 11 having the above-mentioned configuration is described below.

In the receptacle connector 11, when the receptacle-side contact 17 is supported by the terminal supporting part 33, a clearance is formed between the tip of the terminal supporting part 83 and the tip of the receptacle-side contact 17. In the receptacle-side contact 17, the tip part alone becomes a free end that is displaceable in the anti-contact direction.

Figure 6:
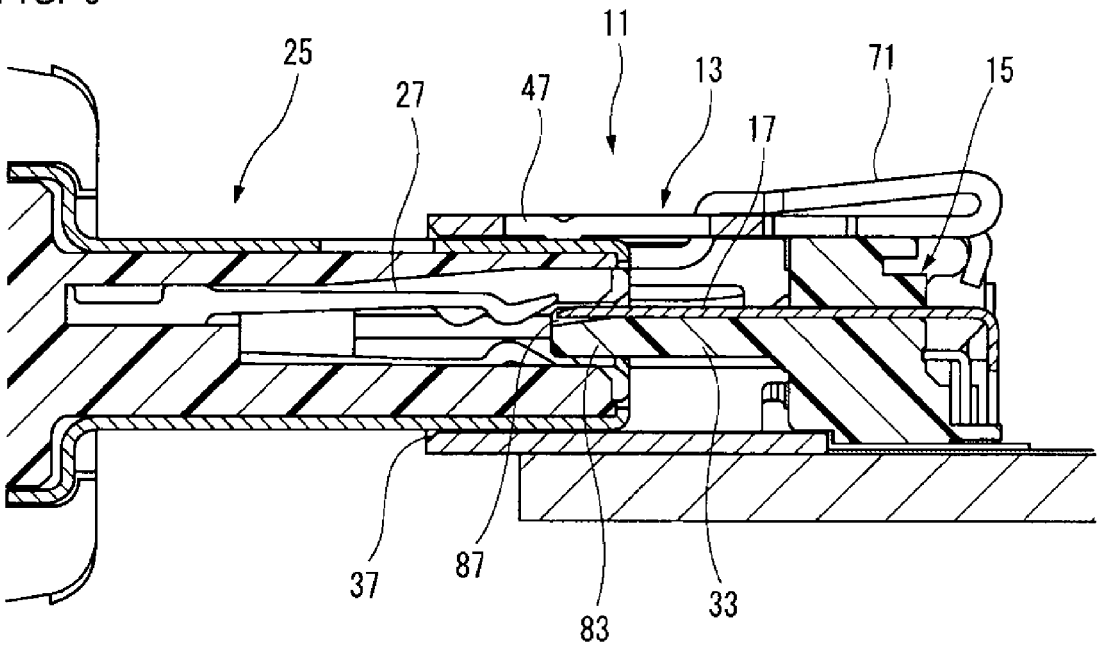
FIG. 6 is a vertical sectional view showing a situation realized at the time of start of fitting between a receptacle connector and a plug connector.
Figure 7A:
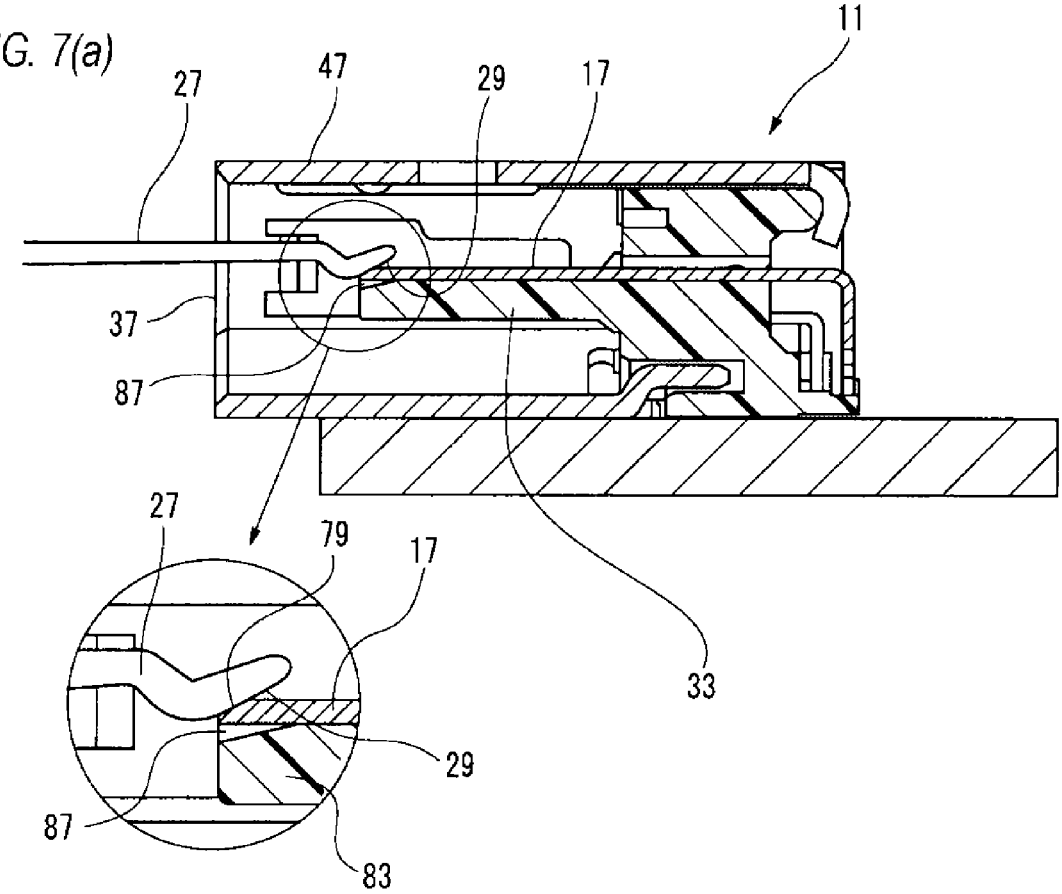
FIG. 7(*a*) is an explanation diagram showing the situation of partner contacts realized immediately before the contact.
Figure 7B:
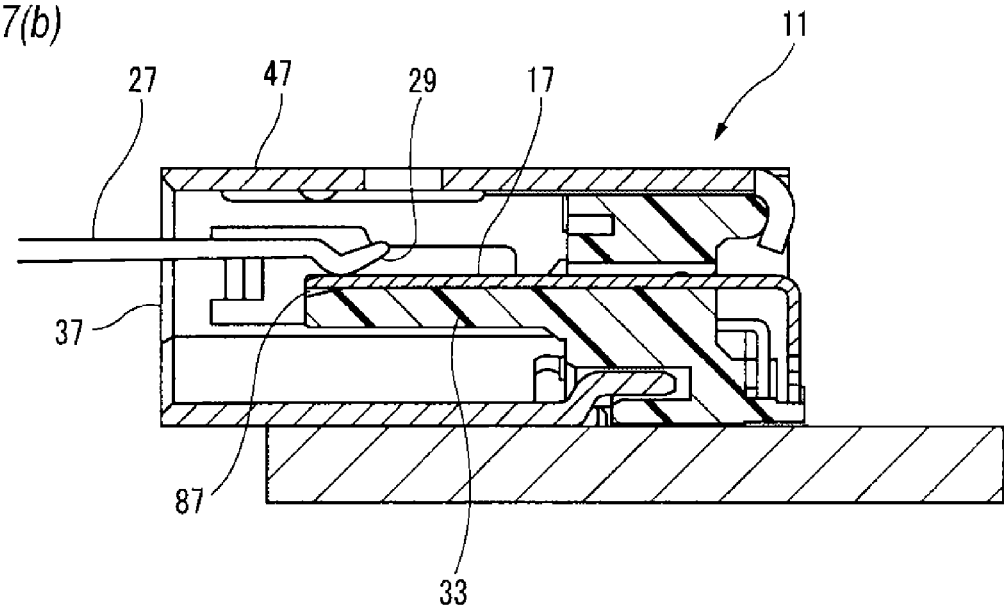
Figure 8:
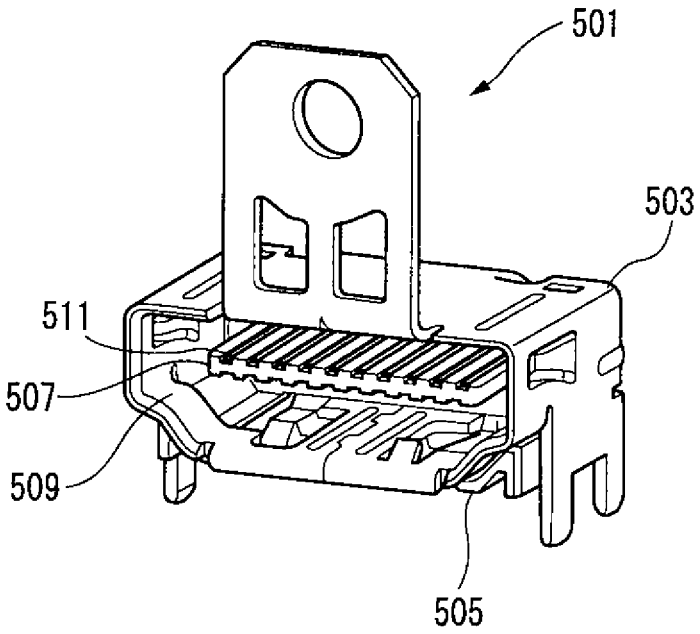
FIG. 8 is an overall perspective view of a related-art receptacle connector.

As shown in FIG. 6, when fitting of the plug connector 25 into the receptacle connector 11 is started, the plug-side contact 27 becomes in contact with the tip of the receptacle-side contact 17 as shown in FIG. 7(*a*). A further insertion force is applied, in the receptacle-side contact 17, the tip part alone is elastically deformed so as to retreat into the back clearance 87 formed by the clearance as shown in FIG. 7(*b*).

This elastic deformation in the tip of the receptacle-side contact 17 reduces the insertion load (the reaction force) generated at the time of contact of the plug-side contact 27 with the receptacle-side contact 17, and thereby suppresses an increase in the insertion resistance. Further, when the insertion load is reduced, the compression force in a direction parallel to the insertion direction that acts between the partner contacts is also reduced. This suppresses the occurrence of deformation (permanent deformation) such as buckling and droop in the plug-side contact 27 and the receptacle-side contact 17.

Further, the back clearance 87 is formed only at the tip of the terminal supporting part 83. This avoids a situation that the receptacle-side contact 17 retreats in the anti-contact direction in a long distance along the direction of extension. This avoids the occurrence of residual deformation that could be generated in the anti-contact direction in a long distance along the direction of extension of the receptacle-side contact 17, and hence avoids, for along time, degradation of reliability of contact with the plug-side contact 27.

Further, at the time that the tip of the receptacle-side contact 17 is elastically deformed in association with the contact with the plug-side contact 27, the back clearance 87 is formed by a space having a wedge shape similar to the locus generated when the free end retreats. Thus, at the time of retreat of the receptacle-side contact 17, excessive deformation is avoided in the receptacle-side contact 17 and stress concentration is avoided that could be caused by abutting of the receptacle-side contact 17 against the tip corner part or the like on the insulator side. This permits stable elastic deformation without the occurrence of permanent deformation.

Thus, according to the receptacle connector 11 according to the present embodiment, the insertion force is reduced so that deformation is hardly generated in the receptacle-side contact 17 and the plug-side contact 27 even in long-term repeated use.

Here, the receptacle connector according to the present invention is not limited to any embodiment described above, and appropriate modifications, improvements, and the like may be applied. In addition, in each component in the embodiment described above, the construction material, the shape, the dimension, the number, the arrangement site, and the like are arbitrary and not limited to specific ones as long as the present invention is allowed to be implemented.

What is claimed is:

1. An electrical receptacle connector comprising:

a shielding case;

an insulator accommodated in the shielding case; and contacts, each of the contacts having a straight contact portion arranged on and along a terminal supporting part of the insulator, each said straight contact portion having a straight end tip portion with a guide surface, wherein a clearance is provided between a tapered surface at an end portion of the terminal supporting part and a surface of the straight end tip portion of the contact, the tapered surface of the end portion of the terminal supporting part extending to an a end of the terminal supporting part, an entirety of the tapered surface of the end portion of the terminal supporting part being inclined with respect to an entirety of the surface of the straight end tip portion of the contact such that the clearance reaches a largest width at the end of the terminal supporting part, and the clearance increases toward the tip end of the terminal supporting part so as to have a wedge shape.

2. The electrical receptacle connector according to claim 1, wherein, when the receptacle connector is fitted to a plug connector, the contact of the receptacle connector is in contact with a contact of the plug connector, the contact of the receptacle connector being allowed to retreat in an anti-contact direction relative to the contact of the plug connector.

3. The electrical receptacle connector according to claim 1, wherein the contact includes a plurality of contacts arranged in a width direction of the terminal supporting part of the insulator.

4. The electrical receptacle connector according to claim 1, wherein the contact includes an upper contact and a lower contact, each of the upper and lower contacts having the straight contact portion, the clearance being formed between the tapered surface of the end portion of the terminal supporting part and the surface of the straight end tip portion of each of the upper and lower contacts.

5. The electrical receptacle connector according to claim 4, wherein, when the receptacle connector is fitted to a plug connector, the upper and lower contacts are in contact with a contact of the plug connector, the upper and lower contacts being allowed to retreat in an anti-contact direction relative to the contact of the plug connector.

6. The electrical receptacle connector according to claim 4, wherein each of the upper contact and the lower contact includes a plurality of contacts arranged in a width direction of the terminal supporting part of the insulator.

* * * * *